US009643041B2

(12) United States Patent
Neill et al.

(10) Patent No.: US 9,643,041 B2
(45) Date of Patent: May 9, 2017

(54) APPARATUS SYSTEM AND METHOD FOR PROVIDING ADJUSTABLE CRANKS IN AN EXERCISE DEVICE

(71) Applicant: Core Health & Fitness, LLC, Vancouver, WA (US)

(72) Inventors: Steve Neill, Simi Valley, CA (US); David Beard, Santa Ana, CA (US); Victor Cornejo, Riverside, CA (US)

( * ) Notice: Subject to any disclaimer, the term of this patent is extended or adjusted under 35 U.S.C. 154(b) by 0 days.

(21) Appl. No.: 14/658,126

(22) Filed: Mar. 13, 2015

(65) Prior Publication Data

US 2015/0258365 A1 Sep. 17, 2015

Related U.S. Application Data

(60) Provisional application No. 61/952,645, filed on Mar. 13, 2014.

(51) Int. Cl.

| | |
|---|---|
| ***A63B 21/00*** | (2006.01) |
| ***A63B 21/008*** | (2006.01) |
| ***A63B 21/012*** | (2006.01) |
| ***A63B 22/06*** | (2006.01) |
| ***A63B 24/00*** | (2006.01) |
| ***A63B 22/00*** | (2006.01) |
| *A63B 21/04* | (2006.01) |

(52) U.S. Cl.

CPC ..... *A63B 21/0088* (2013.01); *A63B 21/0125* (2013.01); *A63B 22/0005* (2015.10); *A63B 22/0605* (2013.01); *A63B 24/0087* (2013.01); *A63B 21/008* (2013.01); *A63B 21/0442* (2013.01); *A63B 21/154* (2013.01); *A63B 2022/0623* (2013.01); *A63B 2022/0629* (2013.01); *A63B 2208/0233* (2013.01); *A63B 2225/09* (2013.01)

(58) Field of Classification Search

USPC ..... 482/1–148

See application file for complete search history.

(56) References Cited

U.S. PATENT DOCUMENTS

| | | | | |
|---|---|---|---|---|
| 3,081,645 A * | 3/1963 | Bergfors | A61H 1/0214 | 482/57 |
| 3,848,870 A * | 11/1974 | Craig | A63B 22/0605 | 108/140 |
| 3,964,742 A * | 6/1976 | Carnielli | A61H 1/0214 | 482/62 |
| 4,402,502 A * | 9/1983 | Peters | A61H 1/0214 | 482/139 |

(Continued)

*Primary Examiner* — Stephen Crow

(74) *Attorney, Agent, or Firm* — Brown IP Law LC; Kerry Brown

(57) ABSTRACT

A crank-driven exercise device (100). The crank-driven exercise device (100) includes a frame (102), a spindle (202) rotatably connected to the frame (102), a crank arm (104) connected to the spindle (202), and a user input (208) connected to the crank arm (104) configured to receive a force from a user. In some embodiments, the crank arm (104) includes a proximal section (204) and a distal section (206). The proximal section (204) may be connected to the spindle (202) at a spindle interface (302), the distal section (206) may be rotatably connected to the user input (208) at a user input interface (306), and the distal section (206) may be selectively fastenable and selectively rotatable relative to the proximal section (204) at a crank interface (304).

18 Claims, 9 Drawing Sheets

(56) References Cited

U.S. PATENT DOCUMENTS 4,881,732 A * 11/1989 Kepiro ..... A63B 22/001
482/62
4,976,426 A * 12/1990 Szabo ..... A63B 21/00178
482/111
5,330,402 A * 7/1994 Johnson ..... A63B 22/0012
482/52
5,860,941 A * 1/1999 Saringer ..... A61H 1/0214
482/4
7,226,394 B2 * 6/2007 Johnson ..... A63B 22/0002
482/57
7,510,512 B1 * 3/2009 Taggett ..... A63B 21/0088
482/111
7,841,969 B1 * 11/2010 Moran ..... A63B 21/157
482/51
8,968,162 B2 * 3/2015 Jaguan ..... A63B 71/023
482/57

* cited by examiner

APPARATUS SYSTEM AND METHOD FOR PROVIDING ADJUSTABLE CRANKS IN AN EXERCISE DEVICE

CROSS-REFERENCE TO RELATED APPLICATIONS

This application claims the benefit of U.S. Provisional Patent Application No. 61/952,645, entitled "Apparatus, System, and Method for Providing Resistance in a Dual Tread Treadmill," which was filed on Mar. 13, 2014, and is hereby incorporated by reference.

SUMMARY

An embodiment of the invention provides a crank-driven exercise device. The crank-driven exercise device includes a frame, a spindle rotatably connected to the frame, a crank arm connected to the spindle, and a user input connected to the crank arm configured to receive a force from a user. In some embodiments, the crank arm includes a proximal section and a distal section. The proximal section may be connected to the spindle at a spindle interface, the distal section may be rotatably connected to the user input at a user input interface, and the distal section may be selectively fastenable and selectively rotatable relative to the proximal section at a crank interface. Other embodiments of dual treadle treadmills are also described.

BRIEF DESCRIPTION OF THE SEVERAL VIEWS OF THE DRAWINGS

Throughout the description, similar reference numbers may be used to identify similar elements.

DETAILED DESCRIPTION

In the following description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

While many embodiments are described herein, at least some of the described embodiments provide a method for providing adjustable cranks in an exercise device.

Figure 1:
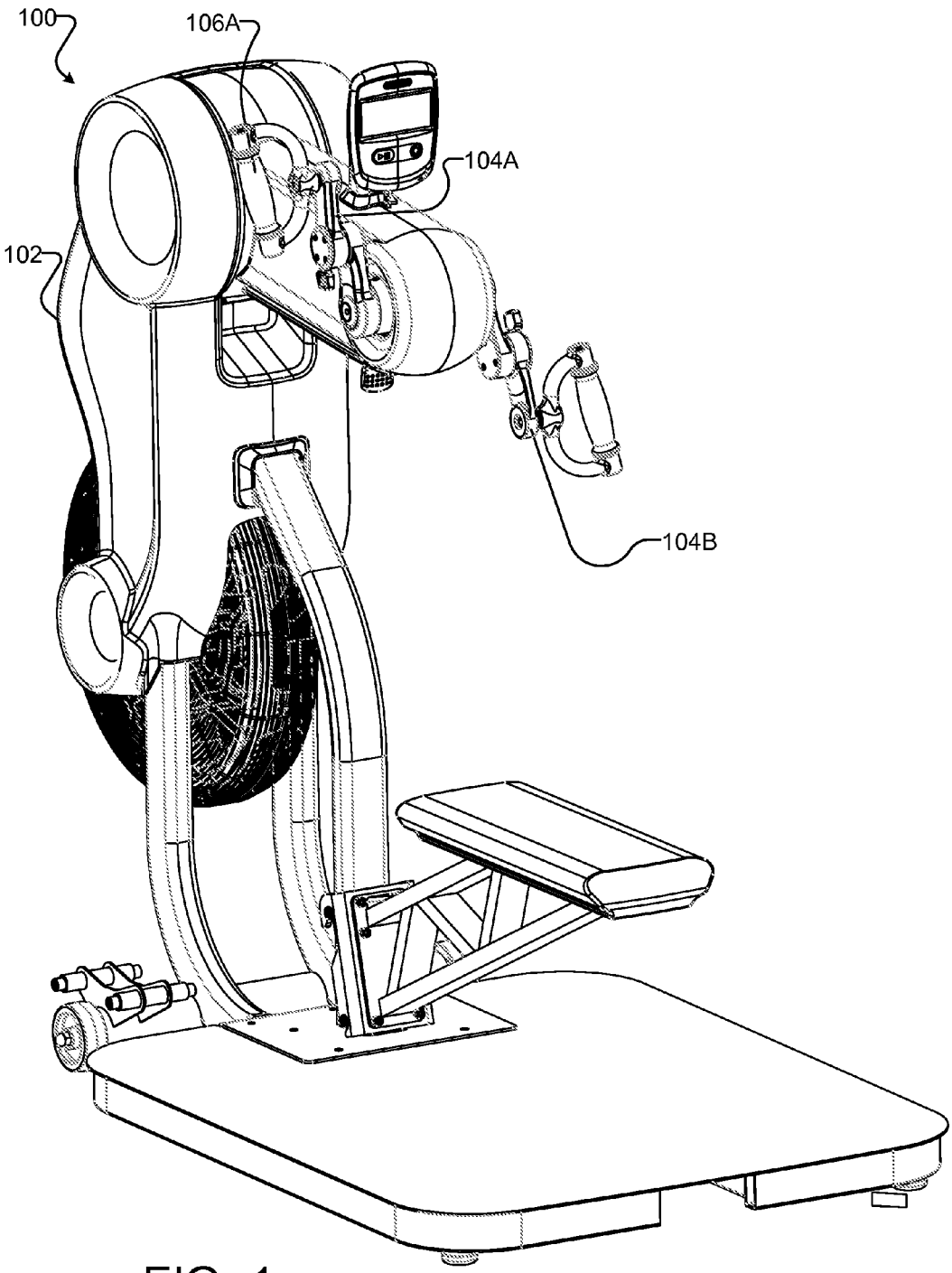
FIG. 1 depicts a perspective view of one embodiment of an exercise device.

FIG. 1 depicts a perspective view of one embodiment of an exercise device 100. The exercise device 100 shown in FIG. 1 is an upper body ergometer ("UBE"), deigned to provide exercise for a user's upper body. In an alternative embodiment, the exercise device 100 may be any other type of exercise device using a crank, including, but not limited to an exercise cycle or a recumbent cycle. The exercise device 100 includes a body 102 and left and right crank arms 104A, 104B. The exercise device 100 provides resistance to rotation of the crank arms 104A, 104B.

The exercise device 100, in certain embodiments, is operated by rotation of the crank arms 104A, 104B. A user may engage the crank arms 104A, 104B by applying force to a user input 106A, such as a handle or a pedal, connected to the crank arms 104A, 104B and rotating the crank arms 104A, 104B relative to the body 102. In the illustrated embodiment, the user input 106A is a handle.

The exercise device 100 may provide resistance to the crank arms 104A, 104B using any known method. In one embodiment, the resistance provided to the crank arms 104A, 104B is variable and controllable. In some embodiments, an electronic device (not shown) such as a microprocessor manages the resistance provided to the crank arms 104A, 104B. Resistance may be provided by an electrical device that converts energy generated by rotation of the crank arms 104A, 104B to another form of energy, such as electricity or heat. In another embodiment, resistance is provided by friction. In one embodiment, resistance is provided by a fan.

Figure 2:
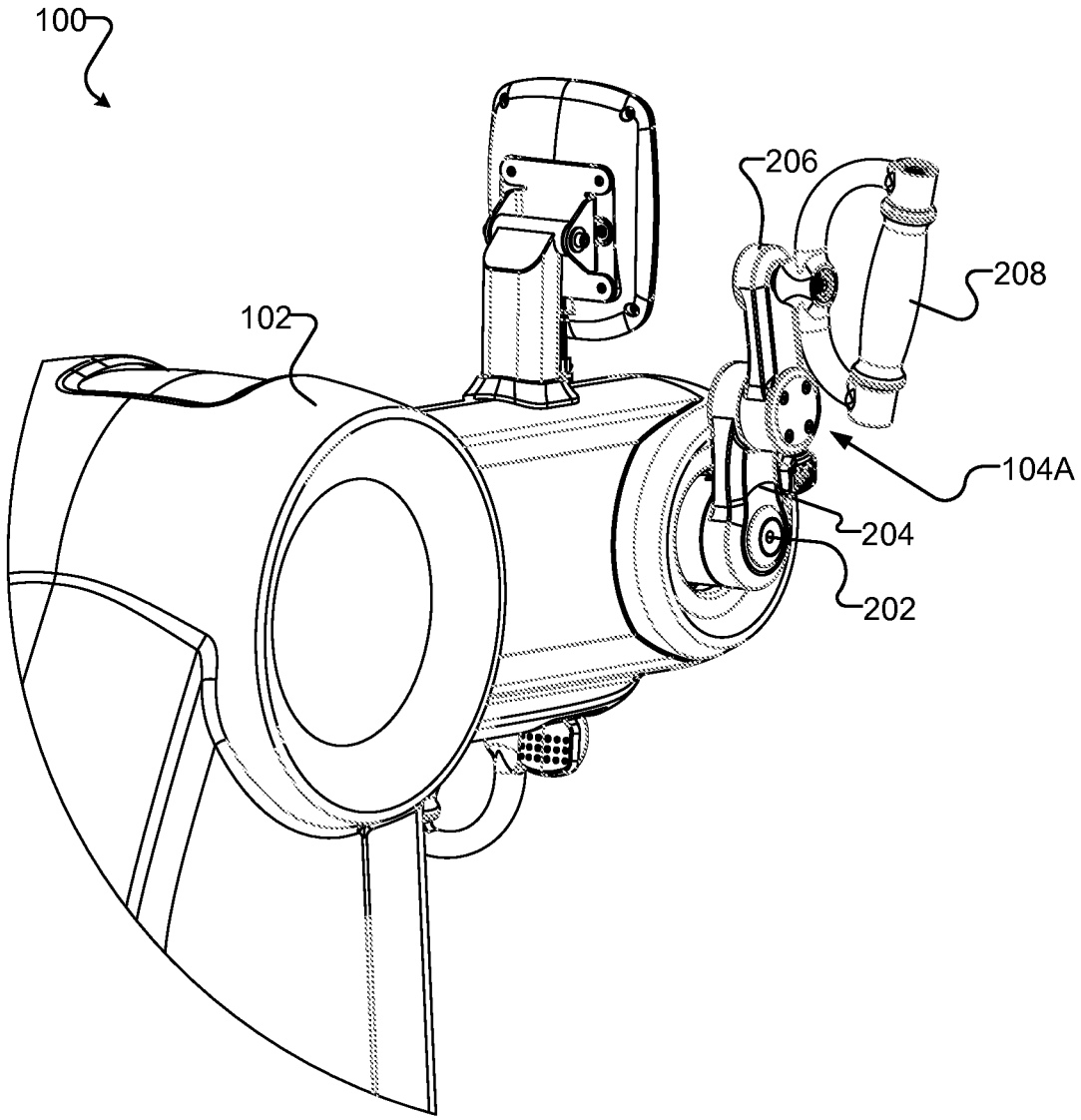
FIG. 2 depicts a perspective view of one embodiment of the exercise device of FIG. 1.

FIG. 2 depicts a perspective view of one embodiment of the exercise device 100 of FIG. 1. The left crank arm 104A, in one embodiment, includes a proximal section 204 and a distal section 206. In some embodiments, the proximal section 204 is connected to a spindle 202 which rotates relative to the body 102 of the exercise device 100.

In some embodiments, the proximal section 204 is permanently or quasi-permanently connected to the spindle 202. For example, the proximal section 204 can be connected to the spindle 202 using a connection that requires a tool for attachment or removal, such as a clamp on the proximal section 204 that uses one or more screws to fasten the clamp to the spindle 202. In one embodiment, the interface between the proximal section 204 and the spindle 202 is keyed such that the proximal section 204 may be connected to the spindle 202 in one or more predetermined orientations. In another embodiment, the proximal section 204 is adjustably connected to the spindle 202. For example, a user-operable lever may be engageable to selectively release and fasten the proximal section 204 to the spindle 202. The proximal section 204 may be rotated relative to the spindle 202 in some embodiments in response to the proximal section 204 being released from the spindle 202 and fastened to the spindle 202 at a user-selectable rotational position in response to the proximal section 204 being fastened to the spindle 202.

The proximal section 204, in some embodiments, is adjustably connected to the distal section 206. In certain embodiments, the distal section 206 may be selectively rotated relative to the proximal section 204. In one embodiment, the distal section 206 may be selectively secured to the proximal section 204 such that rotation relative to the proximal section 206 is resisted. Embodiments of crank arms 104 are discussed in greater detail in relation to subsequent figures below.

In some embodiments, a user input 208 is connected to the distal section 206. The user input 208 provides an engagement for a user to operate the exercise device 100. In some embodiments, the user input 208 is rotatably connected to the distal section 208. In one embodiment, the user input 208 is positioned a predetermined distance from an interface between the proximal section 204 and the distal section 206.

In some embodiments, the left crank arm 104A and the right crank arm 104B are structurally identical. For example, a crank arm may be attached to the left end of the spindle 202 to become the left crank arm 104A, while a substantially identical crank arm may be attached to the right end of the spindle 202 in a rotated orientation to become the right crank arm 104B. In an alternate embodiment, the left crank arm 104A and the right crank arm 104B may be different. For example, the right crank arm 104B may be a mirror image of the left crank arm 104A.

For simplicity, the crank arms 104A, 104B may be referred to as the crank arm 104 throughout this document. Notwithstanding this simplification, it should be noted that in some embodiments, a distinct left crank arm 104A and a distinct right crank arm 104B may be employed and each or either may include any feature described herein. Such implementations are within the scope of this disclosure.

Figure 3:
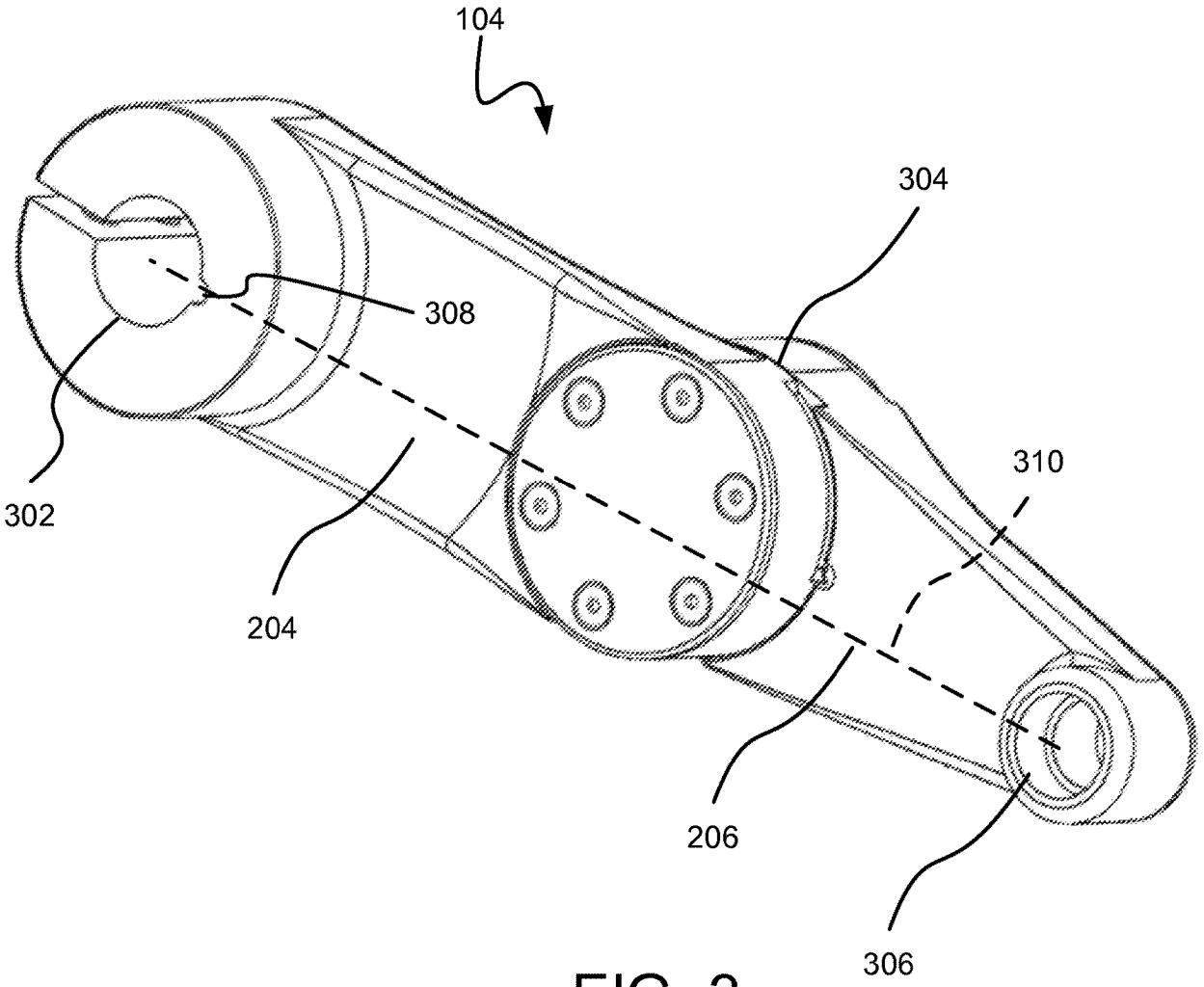
FIG. 3 depicts a perspective view of one embodiment of the crank arm of FIG. 2.

FIG. 3 depicts a perspective view of one embodiment of the crank arm 104 of FIG. 2. The crank arm 104 includes a proximal section 204 and a distal section 206. The crank arm 104 transmits rotation from the user input 208 to the spindle 202.

The proximal section 204 is connectable to the spindle 202 at a spindle interface 302. The proximal section 204 is connected to the distal section 206 at a crank interface 304. The distal section 206 is connected to the user input 208 at a user input interface 306.

The spindle interface 302 may implement any known method for attaching the proximal section 204 to the spindle 202. In some embodiments, the spindle interface 302 may permanently or quasi-permanently connect the proximal section 204 to the spindle 202. In certain embodiments, the spindle interface 302 includes a keyway 308 to interface with a key (not shown) to control the rotational position of the proximal section 204 relative to the spindle 202.

The crank interface 304, in some embodiments, allows for selective rotation of the distal section 206 relative to the proximal section 204. In certain embodiments, the crank interface 304 may be selectively engaged and disengaged, wherein the distal section 206 is free to rotate relative to the proximal section 204 in response to the crank interface 304 being disengaged. Rotation of the distal section 206 relative to the proximal section 204 is resisted in response to the crank interface 304 being engaged. The crank interface 304 is described in greater detail in relation to FIGS. 4-7 below.

The user input interface 306 may implement any known method for attaching the distal section 206 to the user input 208. In certain embodiments, the user input is rotatably connected to the distal section 206 at the user input interface 306.

A crank length 310 is the distance between an axis of the spindle interface 302 and an axis of the user input interface 306. The crank length 310 determines the radius of motion of the user input 208 as the exercise device 100 is operated. Rotation of the distal section 206 relative to the proximal section 204 changes the crank length 310. The crank length 310 is longest when the distal section 206 is not rotated with respect to the proximal section 208. FIG. 3 illustrates the distal section 206 being in line or not rotated with respect to the proximal section 204, consequently the crank length 310 is maximized. For the purposes of this description, having the distal section 206 in line with the proximal section 204 as illustrated in FIG. 3 is referred to as a crank articulation angle of zero degrees. FIGS. 4A-5E illustrate the crank 104 in additional crank articulation angles.

A crank angle is the rotational position of the crank 104 relative to the spindle 202. In a traditional one-piece crank arm, the crank angle is fixed. Typically, in a traditional crank, the left crank and the right crank are attached to the spindle such that their crank angles are 180 degrees apart. Consequently, when one crank is pointing straight up in the traditional crank, the other is pointing straight down.

In some embodiments, the proximal sections 204 of the cranks 104 are affixed to the spindle such that the crank angles of the proximal sections 204 are 180 degrees apart from one another. When the crank articulation angle is zero, as illustrated in FIG. 3, the crank angle of the proximal section 204 matches an effective crank angle defined by a line between the axis of the spindle interface 302 and the axis of the user input interface 306. This effective crank angle changes relative to the crank angle of the proximal section 204 as the crank articulation angle changes.

Figure 4A:
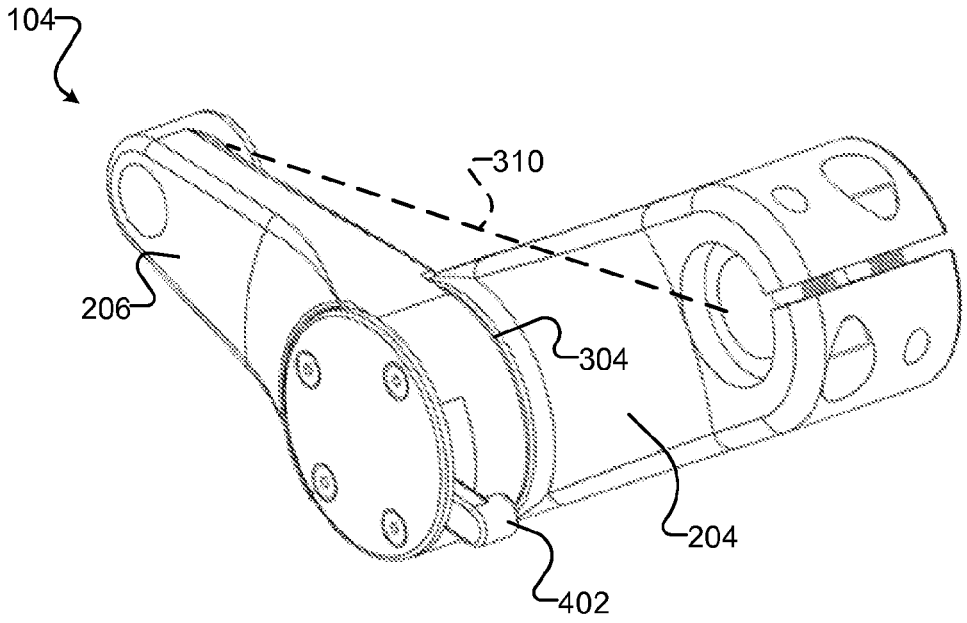
FIGS. 4A and 4B depict a perspective view of one embodiment of the crank arm of FIG. 2 with a release lever in alternate positions.
Figure 4B:
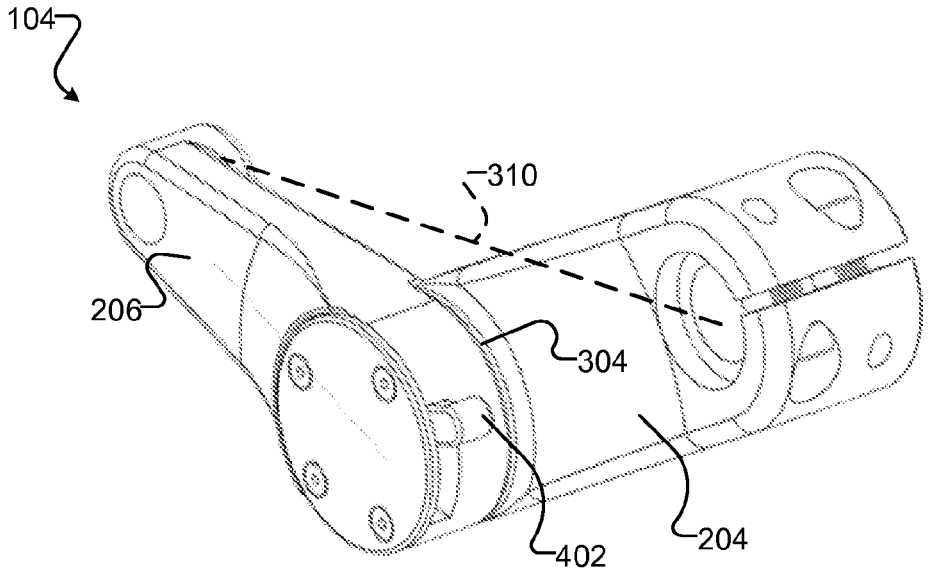

FIGS. 4A and 4B depict a perspective view of one embodiment of the crank arm 104 of FIG. 2 with a release lever 402 in alternate positions. FIG. 4A shows the release lever 402 in a first position. The crank interface 304 is locked in response to the release lever 402 being in the first position. Rotation of the distal section 206 relative to the proximal section 204 is restricted in response to the crank interface 304 being locked.

FIG. 4B shows the release lever 402 in a second position. The crank interface 304 is unlocked in response to the release lever 402 being in the second position. Rotation of the distal section 206 relative to the proximal section 204 is unrestricted in response to the crank interface 304 being unlocked.

FIGS. 4A and 4B show the distal section 206 rotated relative to the proximal section 204, causing the crank articulation angle to be non-zero. The crank length 310 corresponds to the effective length of the crank 104. As noted above in relation to FIG. 3, the crank length 310 is longest when the crank articulation angle is zero degrees. Since the crank articulation angle in FIGS. 4A-4B is non-zero, the effective crank length 310 is less than the maximum crank length illustrated in FIG. 3.

In addition to changing the crank length 310, a non-zero crank articulation angle also changes the effective crank angle relative to the crank angle of the proximal section 204. Note that in some embodiments, the left and right crank articulation angles are independently adjustable. As a result, the left and right cranks may have different effective crank lengths relative to one another and may also have effective crank angles that are an angle other than 180 degrees apart even if the crank angles of the proximal sections 204 are 180 degrees apart. This can result in different forces being applied to the left and right user inputs and out of phase loading. Differing forces and angles for the left and right user inputs may have beneficial therapeutic effects for a user of the exercise device 100.

FIGS. 5A-5E depict a perspective view of one embodiment of the crank arm 104 of FIG. 2 with the proximal section 204 and distal section 206 in various configurations. In some embodiments, the crank articulation angle may be selectively adjustable to a plurality of angles, such as those illustrated in FIGS. 5A-5E. Note that each of the illustrated configurations in FIGS. 5A-5E have different effective crank lengths and different effective crank angles.

Figures 5A, 5B, 5C, 5D, 5E:
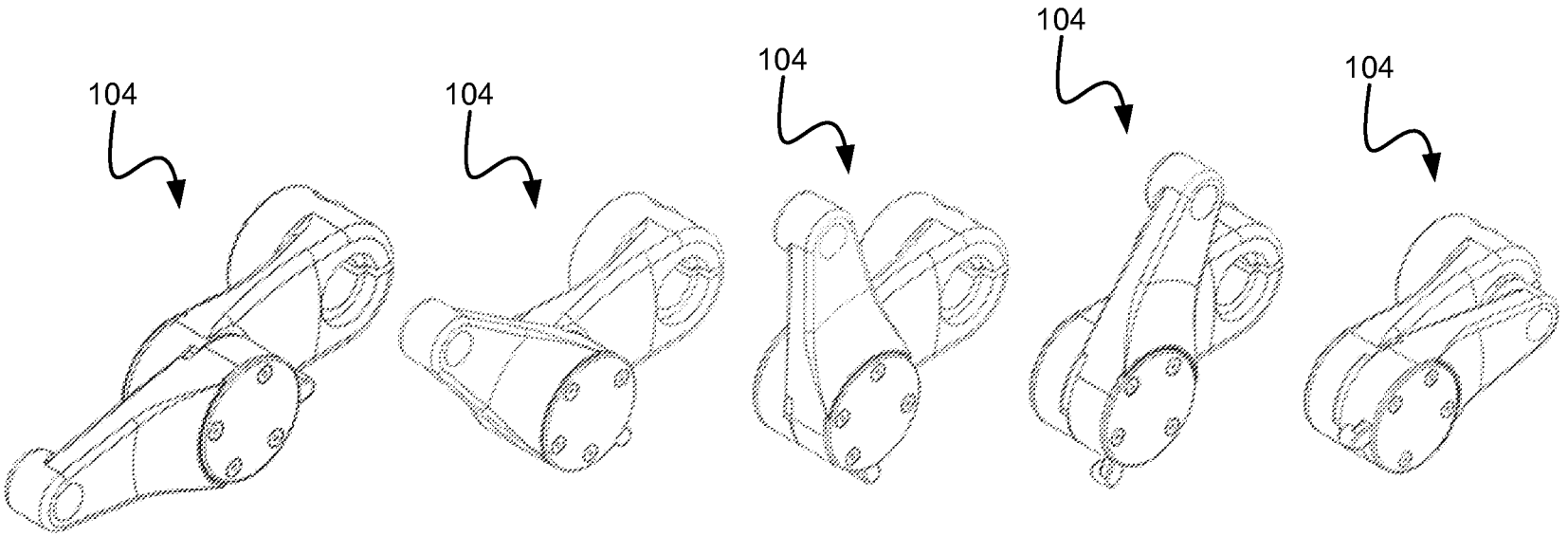
FIGS. 5A-5E depict a perspective view of one embodiment of the crank arm of FIG. 2 with the crank arm in various configurations.

FIG. 5E depicts a special case of one embodiment of the crank 104. In some embodiments, the crank angle may be adjusted such that the user input interface 306 and the spindle interface 302 have a common rotation axis. For example, the distance between the spindle interface 302 and the crank interface 304 may be substantially the same as the distance between the crank interface 304 and the user input interface 306. When the crank articulation angle is 180 degrees, the user input interface 306 and the spindle interface 302 will be at substantially the same axis as the spindle 202.

In this configuration, the user input 208 can remain in a substantially fixed position as the spindle 202 rotates. This can have a beneficial therapeutic effect. For example, due to injury, it may be beneficial for a user to exercise one arm while being required to hold the other, injured arm relatively stationary. By adjusting the crank articulation angle on the crank 104 that corresponds to the injured arm as shown in FIG. 5E, the user can hold the user input 208 using the injured arm and exercise using the opposing arm.

Figure 6:
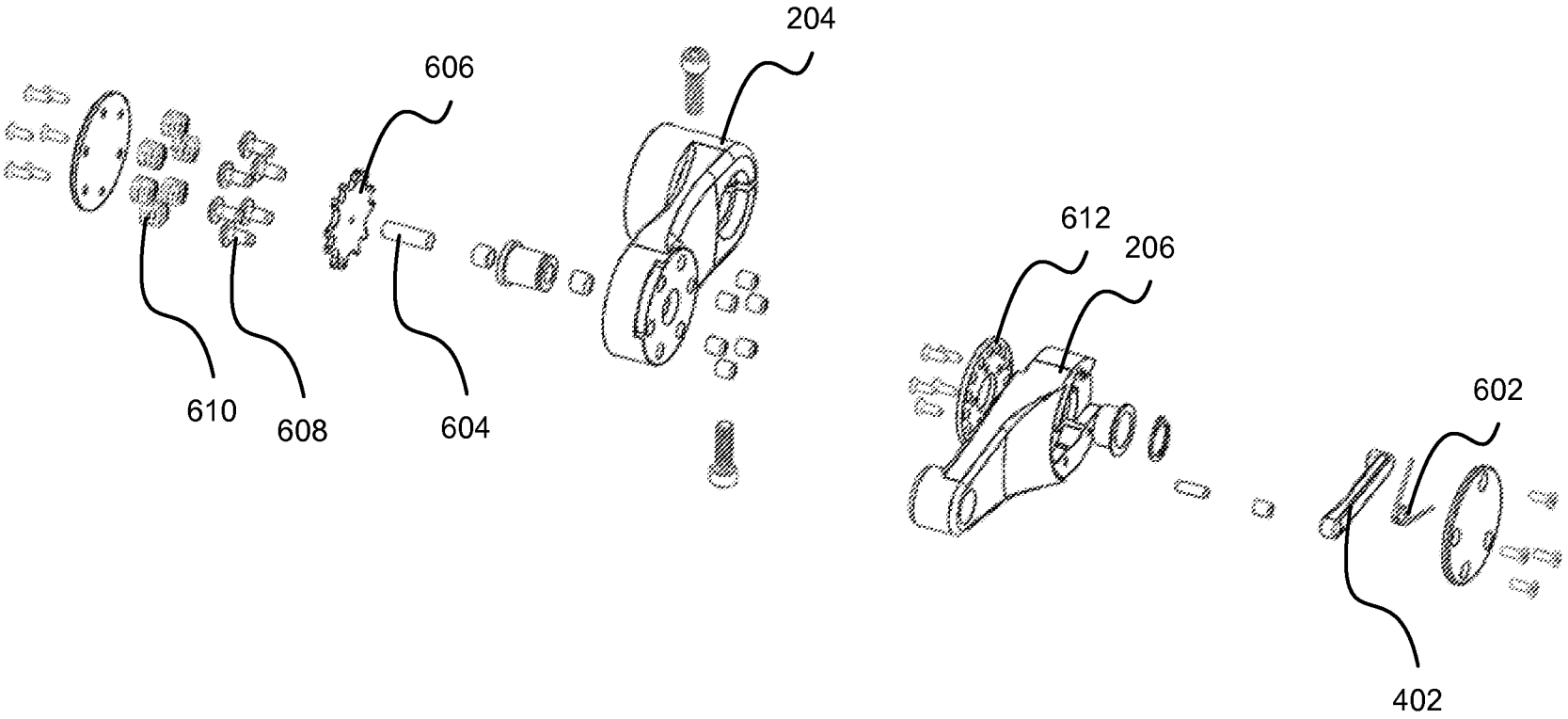
FIG. 6 depicts an exploded perspective view of one embodiment of the crank arm of FIG. 2.

FIG. 6 depicts an exploded perspective view of one embodiment of the crank arm 104 of FIG. 2. The crank arm 104 includes the proximal section 204, the distal section 206, the release lever 402, a torsion spring 602, a center stack 604, a disengagement plate 606, one or more locking pins 608, one or more compression springs 610, and a crank adjustment hub 612. The crank arm 104 is selectively lockable in a plurality of crank articulation angles.

The release lever 402, in one embodiment, is rotatable around a pivot. The torsion spring 602 may be biased to hold the release lever 402 in a first position. Actuation of the release lever 402 may rotate the release lever 402 against the torsion spring 602 to place the release lever in a second position. In some embodiments, releasing the release lever 402 will cause the release lever 402 to return to the first position from the second position in response to the force provided by the torsion spring 602.

In some embodiments, the center stack 604 includes one or more components that are configured to transmit motion from the release lever 402 to the disengagement plate 606. Moving the release lever 402 from the first position to the second position causes the center stack 604 to translate through the crank interface 304. Translation of the center stack 604 causes the disengagement plate 606 to translate away from the crank adjustment hub 612.

The one or more locking pins 608, in one embodiment, move in response to movement of the disengagement plate 606. The one or more compression springs 610 may be biased to push the one or more locking pins 608 toward the crank adjustment hub 612. Translation of the disengagement plate 606 away from the crank adjustment hub 612 may translate the one or more locking pins 608 away from the crank adjustment hub 612 and compress the compression springs 610.

In one embodiment, the locking pins 608 may selectively engage one or more holes in the crank adjustment hub 612. Engagement of one or more locking pins 608 with one or more holes in the crank adjustment hub 612 may result in the crank arm 104 resisting changes to the crank articulation angle. Actuation of the release lever 402 to the second position may result in the one or more locking pins 608 disengaging with the one or more holes in the crank adjustment hub 612 and allow rotation of the proximal section 204 relative to the distal section 206, thus changing the crank articulation angle, the effective crank length, and the effective crank angle.

In some embodiments, the crank angle can be set to a predetermined number of positions related to the number and position of locking pins 608 and the number and position of holes in the crank adjustment hub 612. In the illustrated embodiment, six locking pins 608 are evenly spaced around a central axis and the crank adjustment hub 612 has fifteen holes evenly spaced around the central axis. Due to the geometry of this arrangement, three of the six locking pins 608 engage holes in the crank adjustment hub 612 in any of the predetermined positions. The fifteen holes are spaced twenty four degrees apart on the crank adjustment hub 612, and the six locking pins 608 are sixty degrees apart. When three of the holes on the crank adjustment hub 612 come into alignment with three of the locking pins 608, the three aligned locking pins 608 drop in and lock the crank 104 into one of the predetermined crank articulation angles. This provides twelve degree adjustment steps and thirty predetermined crank articulation angles.

The locking pins 608 and the crank adjustment hub 612 may include any material hard and strong enough to perform the functions described herein. In some embodiments, the one or more locking pins 608 and the crank adjustment hub 612 include relatively hard metals. For example, the one or more locking pins 608 and the crank adjustment hub 612 may include hardened steel. In other embodiments, the one or more locking pins 608 and the crank adjustment hub 612 may include materials including, but not limited to, one or more of titanium, hardened steel, and tool steel.

As will be appreciated by one skilled in the art, a different combination of locking pins 608 and holes could be used to allow for a different number of predetermined crank angles. For example, the crank adjustment hub 612 could include thirty evenly spaced holes along with the six locking pins 608, which would result in sixty predetermined crank articulation angles six degrees apart. In another embodiment, the crank adjustment hub 612 has fifteen predetermined crank angles that are substantially twenty four degrees apart.

In addition, in some embodiments, the crank articulation angle may be infinitely adjustable. For example, the interface between the proximal section 204 and the distal section 206 could be a clamped friction interface, wherein a user could release the clamp, adjust the crank 104 to the desired crank articulation angle, then tighten the clamp to increase the normal force and the frictional force that resists changes to the crank articulation angle.

Figure 7:
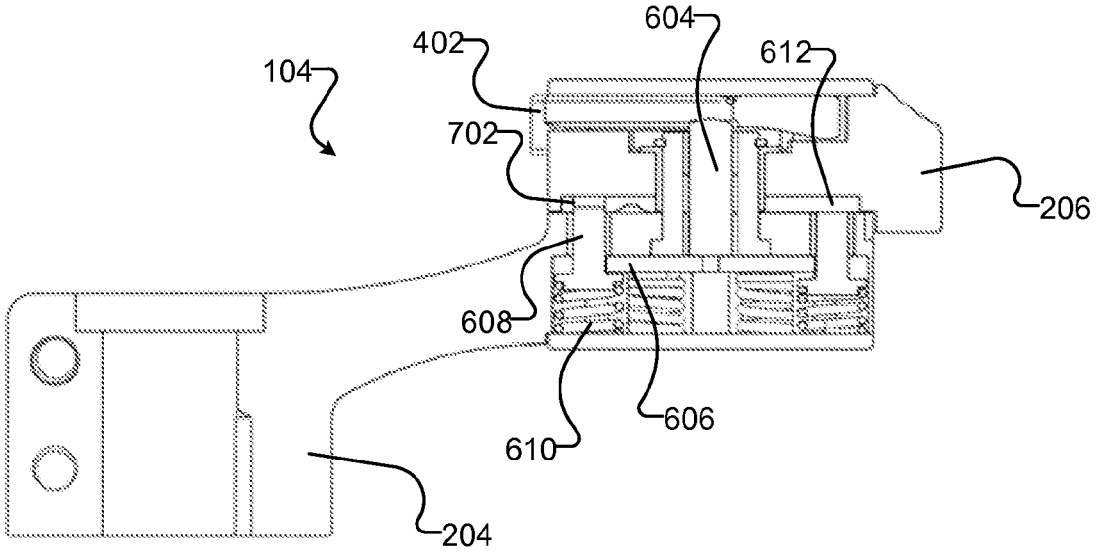
FIG. 7 depicts a cutaway top view of one embodiment of the crank arm of FIG. 2.

FIG. 7 depicts a cutaway top view of one embodiment of the crank arm 104 of FIG. 2. The crank arm includes the proximal section 204, the distal section 206, the release lever 402, the center stack 604, the disengagement plate 606, the one or more locking pins 608, the one or more compression springs 610, the crank adjustment hub 612, and one or more locking holes 702. The crank arm 104 is selectively lockable in a plurality of predetermined crank articulation angles.

In the embodiment illustrated in FIG. 7, the release lever 402 is in the first position and the crank articulation angle is locked. At least one of the one or more locking pins 608, biased by at least one compression spring 610 is engaged in at least one locking hole 702.

In response to movement of the release lever 402 to the second position, the center stack 604 pushes the disengagement plate 606 away from the crank adjustment hub 612. Movement of the disengagement plate 606 away from the crank adjustment hub 612 may cause movement of one or more locking pins 608 away from the crank adjustment hub 612 and out of engagement with the one or more locking holes 702, allowing rotation of the proximal section 204 relative to the distal section 206, thus changing the crank articulation angle, the effective crank length, and the effective crank angle.

In some embodiments, the one or more locking pins 608 are tapered along their shafts. This taper results in the locking pin 608 having a smaller diameter at the end where it initially enters the locking hole 702 than it has at the portion at that engages the locking hole 702 when the locking pin 608 is fully seated in the locking hole 702. The taper may be any type or degree of taper. In one embodiment, the taper is up to fifteen degrees. Locking pins 608 having tapered shafts engage corresponding locking holes 702 more easily and reduce backlash as the crank 104 is locked into position.

In an alternative embodiment, the locking holes 702 are tapered such that the area where the locking pin 608 enters the locking hole 702 is larger than the area of the locking hole 702 where the locking pin 608 fully engages the locking hole 702. In yet another embodiment, both the locking holes 702 and the locking pins 608 are tapered.

Figure 8A:
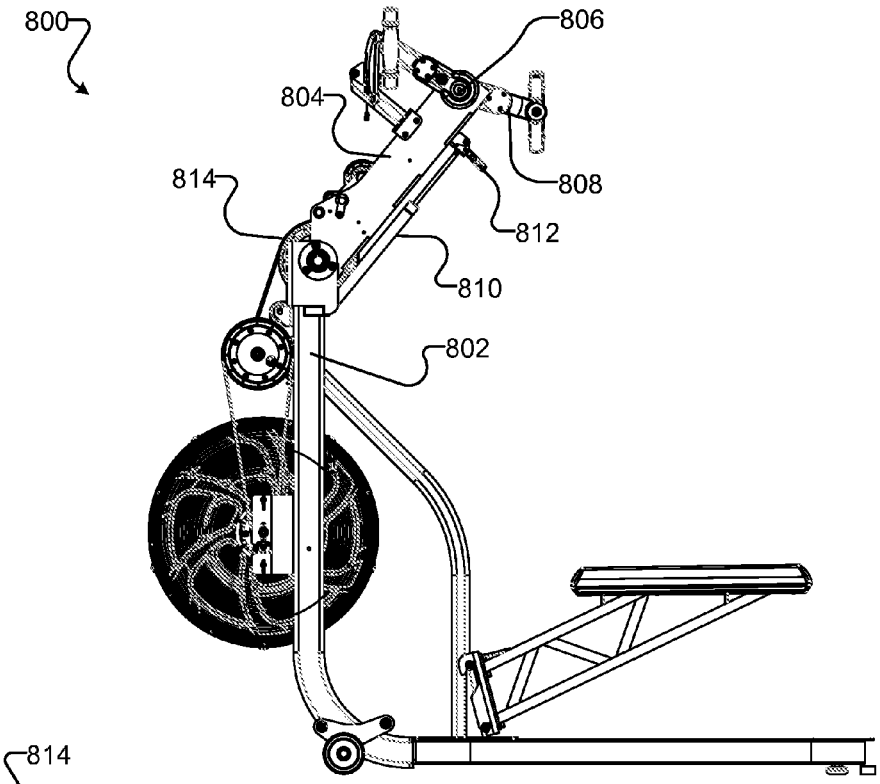
FIGS. 8A and 8B depict a side view of one embodiment of an exercise device with an adjustable height spindle.
Figure 8B:
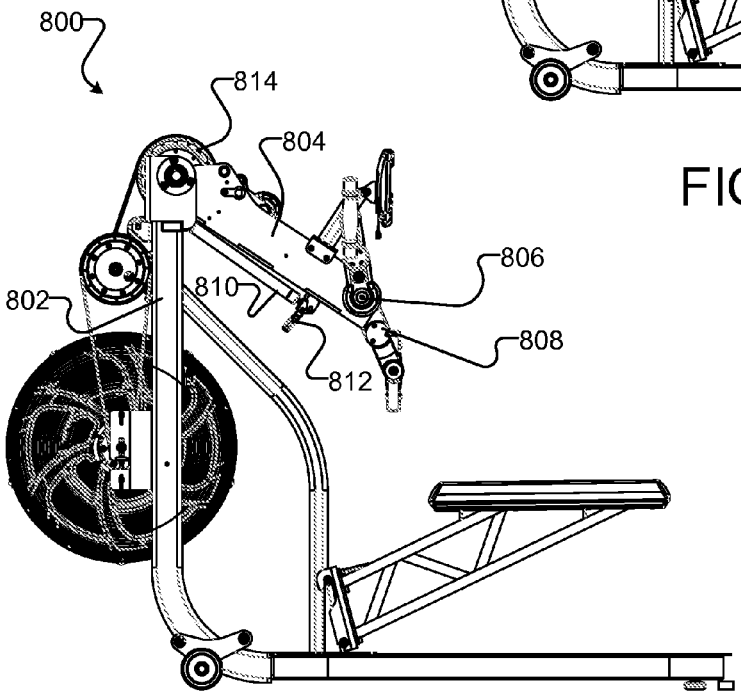

FIGS. 8A and 8B depict a side view of one embodiment of an exercise device 800 with an adjustable height spindle. The exercise device 800 includes a frame 802, a mast 804, a spindle 806, and a crank 808. The exercise device 800 provides adjustable resistance to the crank 808.

In some embodiments, the mast 804 is selectively fastenable and selectively rotatable relative to the frame 802. Rotation of the mast 804 may result in a change in height of the spindle 806 relative to the frame 802. An engagement mechanism 810 may selectively allow rotation of the mast 804 and resist rotation of the mast 804 relative to the frame 802.

In one embodiment, the engagement mechanism 810 is capable of selectively fastening the mast 804 relative to the frame 802 such that the mast 804 resists rotation. In some embodiments, the engagement mechanism 810 allows the mast 804 to be fastened to the frame 802 at a plurality of predetermined positions. In another embodiment, the engagement mechanism 810 allows the mast 804 to be fastened to the frame 802 at any position. In yet another embodiment, the engagement mechanism 810 allows the mast 804 to be fastened to the frame 802 at any position within a predetermined range of rotation of the mast 804. The engagement mechanism 810 may be operated by a user-accessible actuator 812.

The engagement mechanism 810 may be any structure capable of selectively allowing and resisting rotation of the mast 804. For example, the engagement mechanism 810 may be a selectively engageable hydraulic slider. In another example, the engagement mechanism 810 may include a plurality of pins and holes where one or more pins are engageable with one or more holes.

In one embodiment, the mast 804 rotates relative to the frame 802 at a mast interface 812. In certain embodiments, the mast interface 812 shares a common rotation axis with a drive pulley 814. The drive pulley 814 may transfer rotation from the crank 808 to a resistance mechanism.

Figure 9:
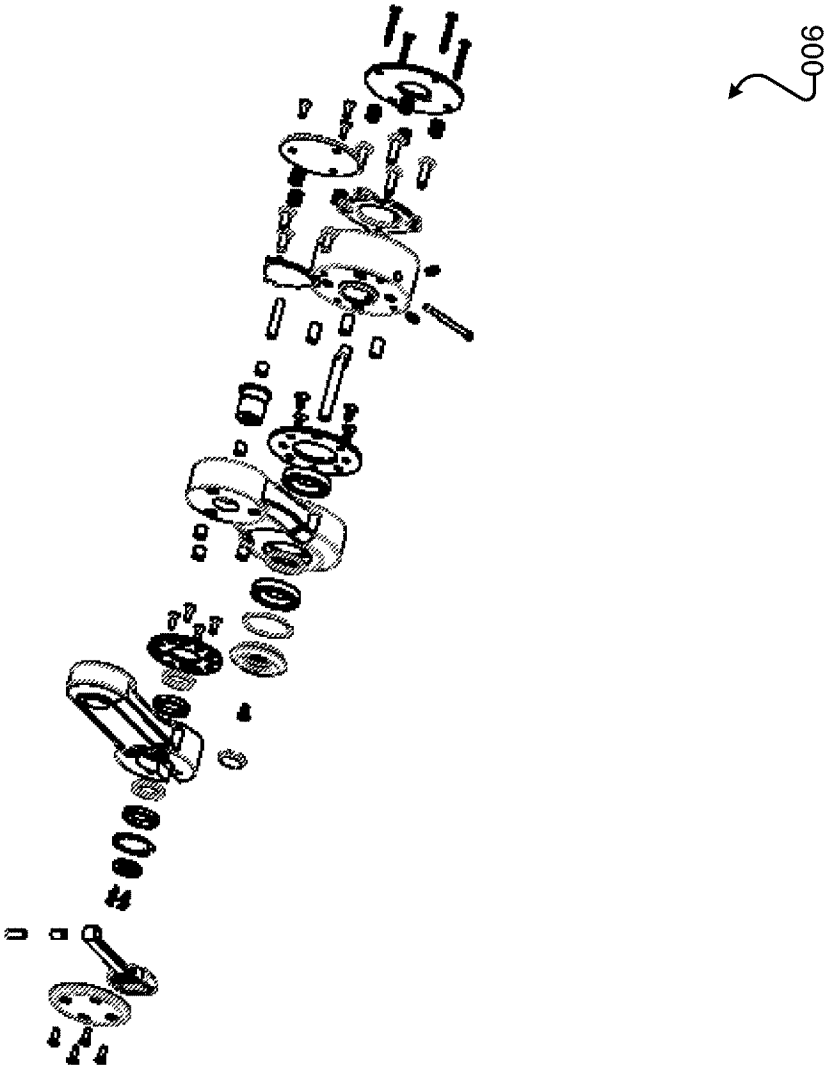
FIG. 9 depicts an exploded view of one embodiment of a crank adjustment mechanism.

FIG. 9 depicts an exploded view of one embodiment of a crank adjustment mechanism 900. The crank adjustment mechanism 900 allows selective engagement, disengagement, and rotation of a crank relative to a spindle.

The components described herein may include any materials capable of performing the functions described. Said materials may include, but are not limited to, steel, stainless steel, titanium, tool steel, aluminum, polymers, and composite materials. The materials may also include alloys of any of the above materials. The materials may undergo any known treatment process to enhance one or more characteristics, including but not limited to heat treatment, hardening, forging, annealing, and anodizing. Materials may be formed or adapted to act as any described components using any known process, including but not limited to casting, extruding, injection molding, machining, milling, forming, stamping, pressing, drawing, spinning, deposition, winding, molding, and compression molding.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Although specific embodiments of the invention have been described and illustrated, the invention is not to be limited to the specific forms or arrangements of parts so described and illustrated. The scope of the invention is to be defined by any claims appended hereto and their equivalents.

What is claimed is:

1. A crank-driven exercise device comprising:
- a frame;
- a spindle rotatably connected to the frame;
- a crank arm connected to the spindle; and
- a user input connected to the crank arm configured to receive a force from a user;
- wherein:
  - the crank arm comprises a proximal section and a distal section;
  - the proximal section is connected to the spindle at a spindle interface;
  - the distal section is rotatably connected to the user input at a user input interface; and
  - the distal section is selectively fastenable and selectively rotatable relative to the proximal section at a crank interface;
  - wherein the distal section is rotatable relative to the proximal section in response to activation of a release lever.

2. The crank-driven exercise device of claim 1, wherein the distal section is selectively fastenable to the proximal section at a user-selectable angle relative to the proximal section such that the distal section resists rotation relative to the proximal section in response to the proximal section and the distal section being fastened.

3. The crank-driven exercise device of claim 1, wherein the release lever returns to a deactivated state in response to the release no longer being activated and the distal section is fastened to the proximal section in response to the release returning to the deactivated state.

4. The crank-driven exercise device of claim 1, wherein a crank length between the spindle interface and the user input interface is adjustable in response to rotation of the distal section relative to the proximal section.

5. The crank-driven exercise device of claim 1, wherein the distal section is fastenable to the proximal section at a predetermined number of angles relative to the proximal section.

6. The crank-driven exercise device of claim 5, wherein the predetermined number of angles relative to the proximal section is fifteen.

7. The crank-driven exercise device of claim 1, wherein the distal section is fastenable to the proximal section at any angle relative to the proximal section.

8. The crank-driven exercise device of claim 1, wherein a distance between the spindle interface and the crank interface and a distance between the crank interface and the user input interface are substantially equal.

9. The crank-driven exercise device of claim 8, wherein the distal section is fixable relative to the proximal section such that the user input rotates around an axis substantially co-linear with an axis around which the spindle rotates.

10. The crank-driven exercise device of claim 1, further comprising:

a second crank, wherein the second crank comprises a second proximal section and a second distal section;

wherein:

the second proximal section connected to the spindle at a second spindle interface;

the second distal section connected to a second user input at a second user input interface; and the second proximal section is connected to the second distal section at a second crank interface.

11. The crank-driven exercise device of claim 10, wherein an angle between a line from the spindle interface to the user input interface and a line between the second spindle interface and the second user input interface is adjustable in response to rotating the distal section relative to the proximal section.

12. The crank-driven exercise device of claim 10, wherein the proximal section is selectively fastenable to the spindle at the spindle axis and selectively rotatable relative to the spindle axis.

13. The crank-driven exercise device of claim 12, wherein the proximal section is selectively fastenable to the spindle at a user-selectable angle relative to the spindle such that the distal section resists rotation relative to the proximal section in response to the proximal section and the distal section being fastened.

14. The crank-driven exercise device of claim 12, wherein an angle between a line from the spindle interface to the user input interface and a line between the second spindle interface and the second user input interface is adjustable in response to rotating the proximal section relative to the second proximal section.

15. A crank-driven exercise device comprising:

a frame;

a spindle rotatably connected to the frame;

a crank arm connected to the spindle; and a user input connected to the crank arm configured to receive a force from a user;

wherein:

the crank arm comprises a proximal section and a distal section;

the proximal section is connected to the spindle at a spindle interface;

the distal section is rotatably connected to the user input at a user input interface;

the distal section is selectively fastenable to the proximal section at a crank interface;

the distal section is rotatable around the crank interface relative to the proximal section in response to the proximal section and the distal section being unfastened; and the distal section is fastenable to the proximal section at a user selected angle relative to the proximal section;

wherein the distal section is rotatable relative to the proximal section in response to activation of a release lever.

16. The crank-driven exercise device of claim 15, wherein the user input comprises a handle for engaging a user's hand.

17. The crank-driven exercise device of claim 15, wherein the user input comprises a pedal for engaging a user's foot.

18. A crank-driven exercise device comprising a frame;

a spindle rotatably connected to the frame;

a crank arm connected to the spindle; and a handle connected to the crank arm configured to receive a force from a user;

wherein:

the crank arm comprises a proximal section and a distal section;

the proximal section is connected to the spindle at a spindle interface;

the distal section is rotatably connected to the handle at a user input interface;

the distal section is selectively fastenable to the proximal section at a crank interface;

the distal section is rotatable around the crank interface relative to the proximal section in response to activation of a release lever;

the distal section is fastenable to the proximal section at a user selected angle relative to the proximal section; and wherein the distal section is fastenable to the proximal section at a predetermined number of angles relative to the proximal section.

* * * * *